US005889265A

United States Patent [19]

Lee

[11] Patent Number: 5,889,265

[45] Date of Patent: Mar. 30, 1999

[54] POWER SUPPLY CUT-OFF APPARATUS OF A MICROWAVE OVEN

[75] Inventor: Jung-Ho Lee, Seoul, Rep. of Korea

[73] Assignee: Samsung Electronics Co., Ltd., Suwon, Rep. of Korea

[21] Appl. No.: 871,521

[22] Filed: Jun. 9, 1997

[30] Foreign Application Priority Data

Jul. 1, 1996 [KR] Rep. of Korea ..... 1996-19551 U
Feb. 25, 1997 [KR] Rep. of Korea ..... 1997-5830

[51] Int. Cl.[6] ..... H05B 6/68

[52] U.S. Cl. ..... 219/723; 219/715; 219/756; 200/50.02; 307/328

[58] Field of Search ..... 219/723, 722, 219/724, 702, 715, 756; 200/50.02, 50.14, 50.1, 50.08, 61.62, 61.76, 61.81; 307/89, 90, 91, 318

[56] References Cited

U.S. PATENT DOCUMENTS 4,277,659 7/1981 DeRemer ..... 200/61.62
5,742,221 4/1998 Baeg ..... 200/293
5,780,792 7/1998 Fritts et al. ..... 200/50.02

FOREIGN PATENT DOCUMENTS 55-56534 4/1990 Japan ..... 219/722

*Primary Examiner*—Philip H. Leung
*Attorney, Agent, or Firm*—Burns, Doane, Swecker & Mathis, L.L.P.

[57] ABSTRACT

A microwave oven includes a power cord for supplying electrical power to electrical components of the oven. Wires of the cord are connected to a first set of terminals of a switch mounted on a main body of the oven. Electrical power is conducted from the first set of terminals to a second set of terminals of the switch by means of conductors carried by an outer panel of the oven that can be removed from the main body. The second set of terminals are connected to electrical components of the oven. When the outer panel is removed from the main body, the first set of terminals is disconnected from the second set of terminals, and an electrically insulative cover is spring biased to a position covering the sets of terminals.

5 Claims, 5 Drawing Sheets

POWER SUPPLY CUT-OFF APPARATUS OF A MICROWAVE OVEN

BACKGROUND OF THE INVENTION

1. Field of the Invention

The present invention relates to a microwave oven and, in particular, to a power supply cut-off apparatus by which an input power supply can be automatically cut off when an outer panel is separated in a state of an electric cord still being plugged in an outlet under repair.

2. Description of the Prior Art

A conventional microwave oven, as illustrated in FIGS. 1 and 2, includes a main body and a removable outer panel 50. The main body comprises a cooking chamber 60, a front panel 20, a back panel 30, and a base panel 40, a turn table 70 rotatively disposed on a floor of the cooking chamber 60, a door for opening and closing an opening of the cooking chamber 60, and a control unit 90 for establishing cooking function modes or for operating a magnetron (not shown), or the like.

In order to drive the microwave oven thus constructed, when a door-open button at the control unit 90 is pressed in a state of an electric cord 100 still in an outlet, the door 80 is opened to light a lamp in the cooking chamber 60.

At this time, food is placed on the turntable 70 disposed on the floor of the cooking chamber 60, the door 80 is closed, desired cooking time and cooking menu and the like are input by the control unit 90, and a start button is pressed. Then the turntable 70 is rotated in one direction as a high frequency of 2,450 MHz is generated according to an oscillating operation of a magnetron (not shown) to thereafter be dispersed in the cooking chamber 60.

The high frequency dispersed in the cooking chamber 60 is reflected from metal walls therein and is radiated to the food on the turntable 70 to thereby heat the food.

However, there is a problem in the conventional microwave oven thus constructed in that an electric shock to a worker can happen because there is no safety measure to automatically cut off the power supply applied to the microwave oven when the outer panel 50 is separated while the electric cord 100 is still in the outlet during repair or maintenance of the product.

SUMMARY OF THE INVENTION

Accordingly, the present invention is provided to solve the aforementioned problem and it is an object of the present invention to provide a power supply cut-off apparatus of a microwave oven by which an input power supply can be automatically cut off to thereby prevent an electric shock even if the outer panel is separated in a state where an electric cord is still in an outlet during repair of the product.

In accordance with the object of the present invention, there is provided a microwave oven comprising a main body forming a cooking chamber, a microwave generator component disposed in the main body for supply microwaves to the cooking chamber, an electric cord for supplying electricity, an outer panel removably mounted on the main body, and a switch mounted on the main body and including terminals electrically connected to respective electrical components of the microwave oven, including a microwave generator component. A switch cover is mounted on the main body for movement between first and second positions in which the electrical cord is electrically connected to and disconnected from, respectively, the terminals. A pusher is mounted on the removable outer panel for pushing the switch cover out of the second position and into the first position in response to the outer panel being attached to the main body.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF THE PREFERRED EMBODIMENT OF THE INVENTION

Figure 1:
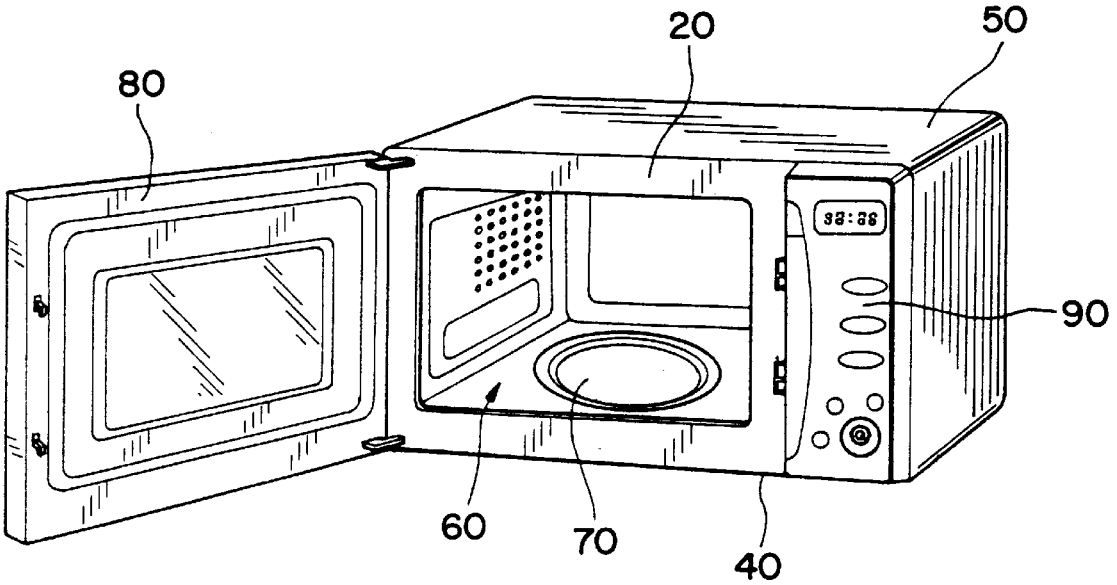
FIG. 1 (PRIOR ART)
FIG. 1 is a front perspective view of a microwave oven according to the prior art.
Figure 2:
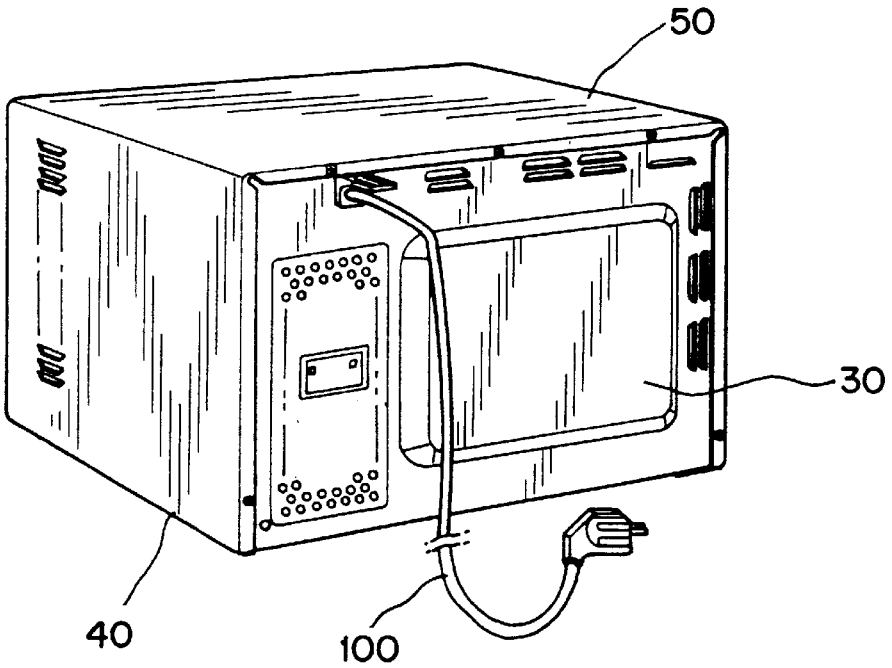
FIG. 2 (PRIOR ART)
FIG. 2 is a rear perspective view of a microwave oven according to the prior art.

An embodiment of the present invention will now be described in detail with reference to the accompanying drawings. Throughout the drawings, like reference numerals and symbols are used for designation of like or equivalent parts or portions for simplicity of illustration and explanation, and redundant reference will be omitted.

A power supply cut-off apparatus according to an embodiment of the present invention, as illustrated in FIGS. 3, 4, 5 and 6, includes push means 210 disposed at a predetermined portion on an outer panel 50, switch means 220 mounted in a cavity 10 of a main body of the oven in order to turn on or turn off electric power supply applied to the microwave oven in response to movement of the push means 210, and switch cover means 230 mounted in the cavity in order to be pushed open by the push means 210 when the outer panel 50 is assembled to the main body, and at the same time, to cover the switch means 220 when the outer panel 50 is separated.

Figure 3:
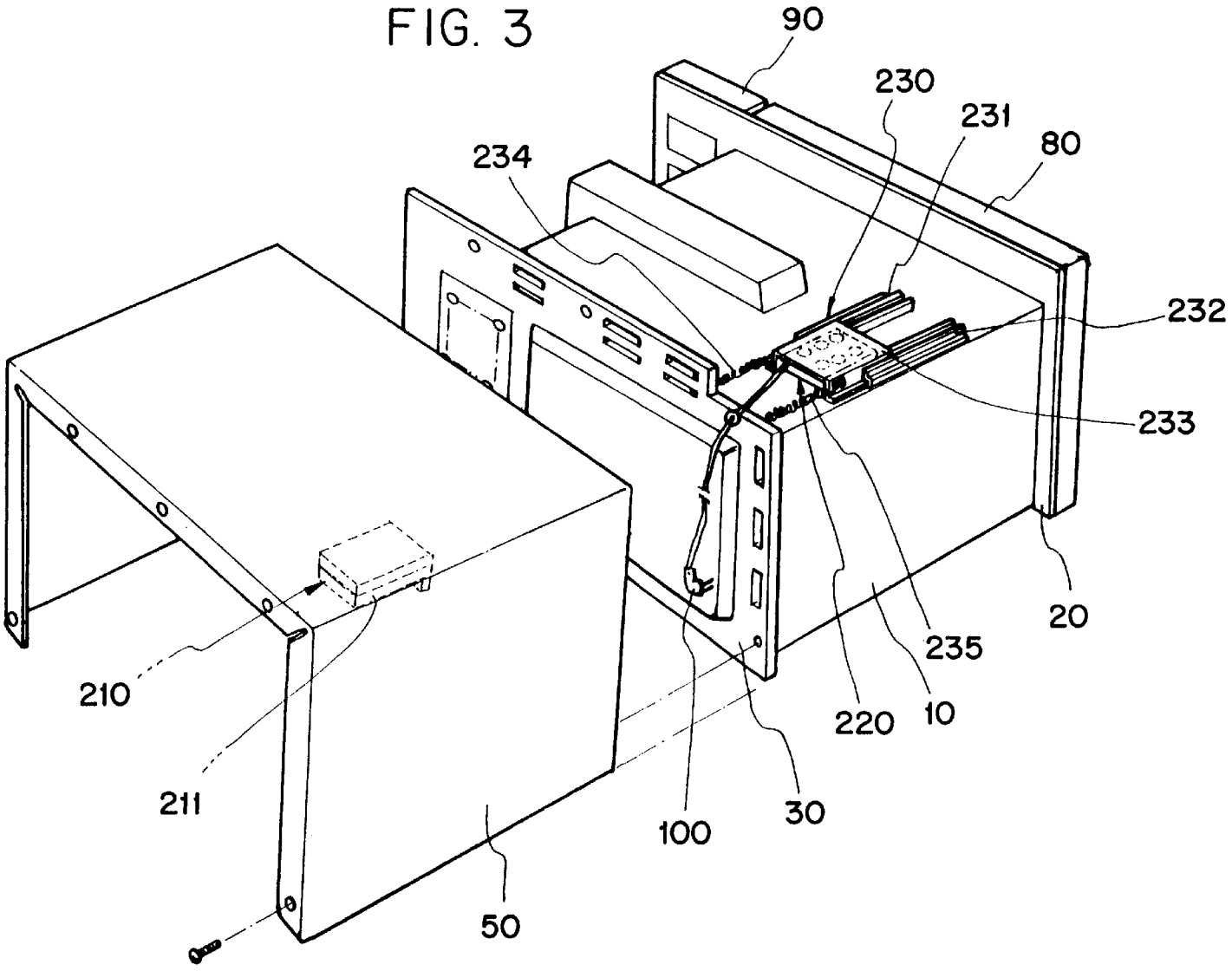
FIG. 3 is an exploded perspective view for illustrating a back panel and an outer panel according to the present invention.
Figure 5:
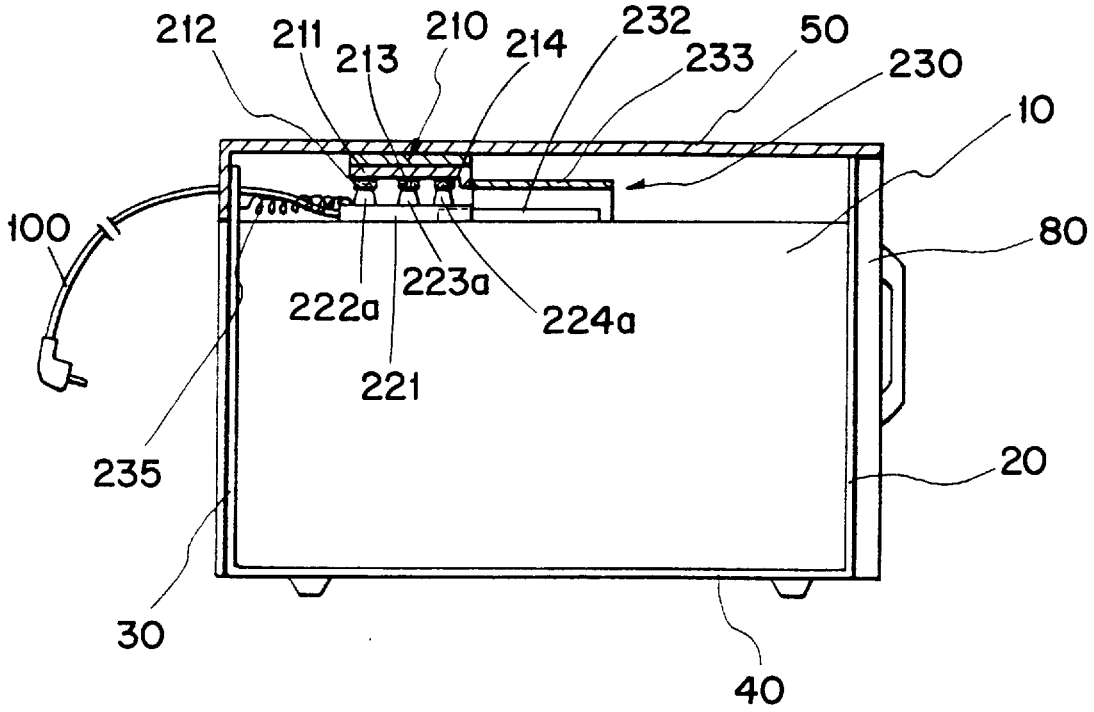
FIG. 5 is a vertical sectional view of a power-on state of the power supply cut-off apparatus according to the present invention.
Figure 6:
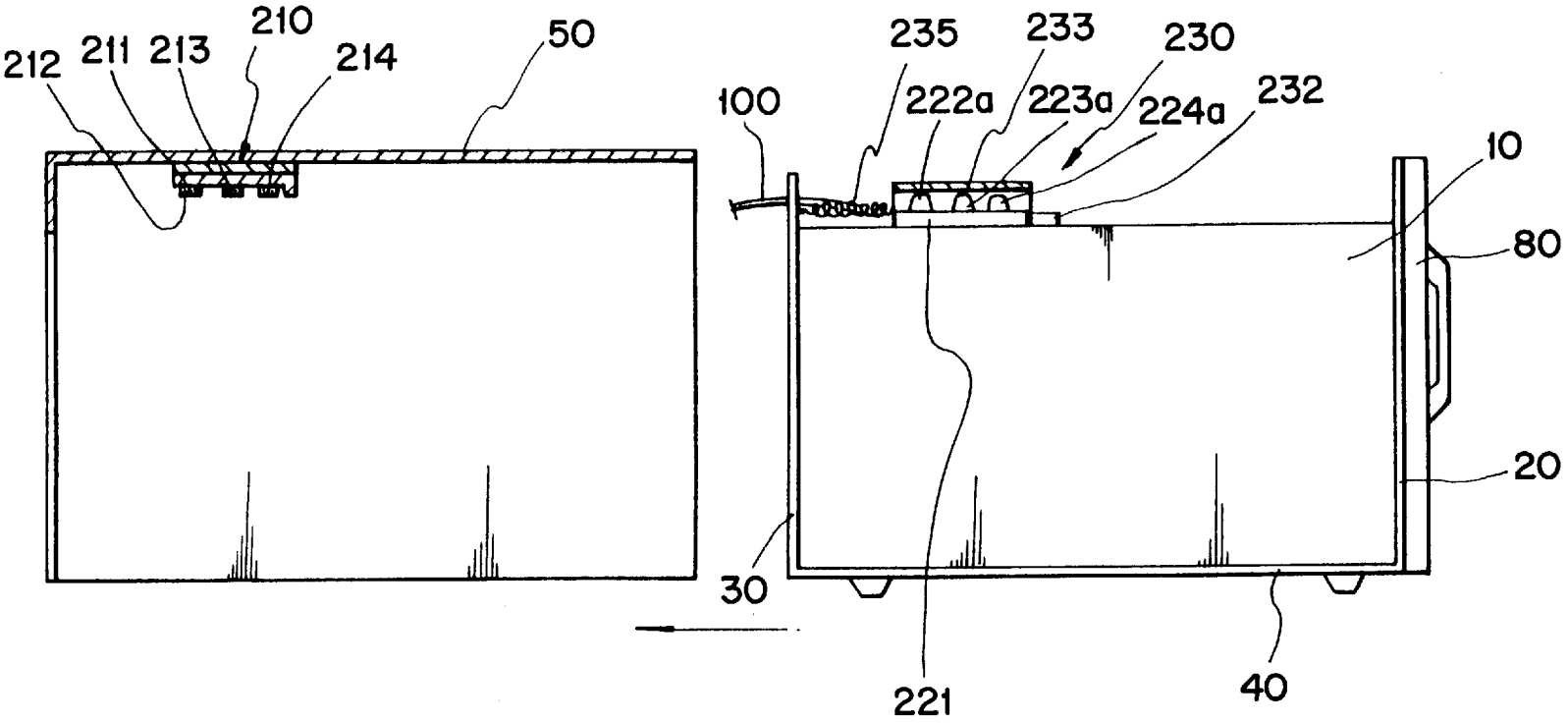
FIG. 6 is a vertical sectional exploded view of a power-off state of the power supply cut-off apparatus according to the present invention.

The push means 210, as illustrated in FIGS. 3 and 5, includes an electric insulating member 211 attached to an inner surface of the outer panel 50, a negative pole 212, a positive pole 213 and an earth connection board 214 attached at predetermined intervals to a surface of the insulating member 211.

The switch means 220 comprises a switch 221 on an upper side of which are provided at predetermined intervals, a first negative pole 222, a first positive pole 213 and a first earth connection point 224, and a second negative pole 222*a*, a second positive pole 223*a* and a second earth connection point 224*a*, which can be placed in electric contact respectively with the negative pole 212, positive pole 213 and earth connection board 214 formed on the push means 210.

Figure 4:
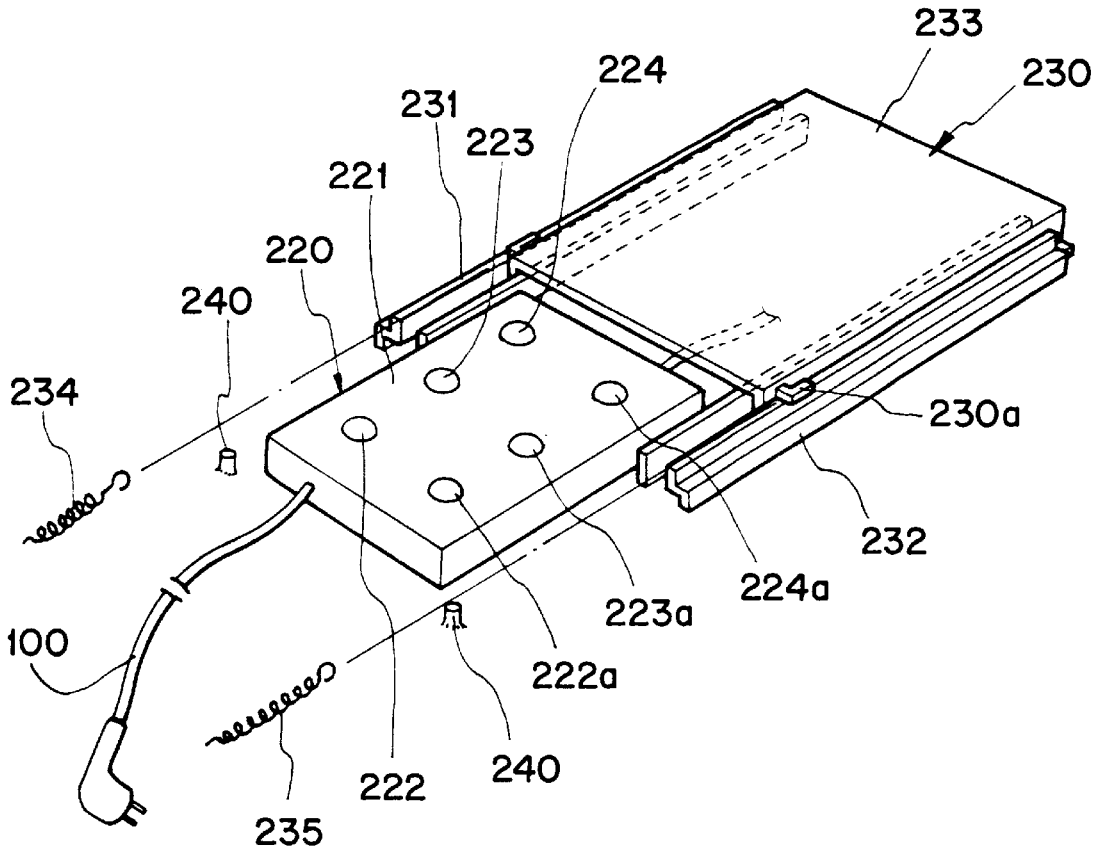
FIG. 4 is a perspective view for illustrating a power supply cut-off apparatus according to the present invention.

That is to say, the first negative pole 222, first positive pole 223 and first earth connection point 224, as illustrated in FIG. 4, are electrically connected respectively with three electric wires of the electric power cord 100, and the second negative pole 222*a*, second positive pole 223*a* and second earth connection point 224*a* are electrically connected respectively with three electric wires of electric components (not shown) disposed in the oven.

Meanwhile, the switch cover means 230 includes first and second guide rails 231 and 232 that are fixed at a predetermined interval to an outer surface of the cavity 10. A cover member 233 is supported for sliding movement along the first and second guide rails 231 and 232 so as to expose or cover the switch means 220, and first and second springs 234 and 235 are connected between the back panel 30 and cover member 233 so that the cover member 233 may be pulled to a position to cover the switch means 220 when the outer panel 50 is separated.

The cover member 233 is made of an insulating material having a high electric resistance. And, one end of each spring 234 is connected with a spring fixing member 230*a* formed at a respective side of the switch cover means 230.

Meanwhile, the cavity 10 is provided at its outer side with at least two stop means 240 so that the cover member 233 can stop at a place where the cover member covers the whole area of the switch means 220 when the cover member 233 moves along the first and second guide rails 231 and 232 in a direction to cover the switch means 200 under the elastic force of the first and second springs 234 and 235.

The stop means 240 is formed on the outer side of the cavity 10 by a forming process, or fixedly attached by inserting therein fastening pins.

Next, the operation of the power supply cut-off apparatus of a microwave oven according to one embodiment of the present invention thus constructed will be described.

When the panels of the oven are to be opened-up for repair or maintenance, e.g., when the outer panel 50 and the back panel 30 are disconnected from one another according to dismantlement of a screwed coupling, and the outer panel 50 is pulled backward as illustrated in FIG. 3, the outer panel 50 is separated from the back panel 30 so that an upper external side of the cavity 10 and both external sides are exposed to the outside.

Furthermore, the push means 210 fixed to the upper inner-side of the outer panel 50 is moved together with the outer panel 50 and is disconnected from the switch means 220 and the switch cover means 230.

In other words, the negative pole 212, positive pole 213 and earth connection board 214, which are attached to one side of the insulating member 211, are electrically disconnected from the first and second negative poles 222, 222*a*, first and second positive poles 223, 223*a* and first and second earth connection portions 224 and 224*a*, so that the first negative pole 222, first positive pole 223 and first earth connection portion 224 which are in electric contact with three wires of the power supply cord 100 are electrically disconnected from the second negative pole 222*a*, second positive pole 223*a* and second earth connection portion 224*a* which are in electric contact with three wires of electric components disposed within the oven.

Since the first negative pole 222, first positive pole 223 and first earth connection portion 224 are electrically disconnected from the second negative pole 222*a*, second positive pole 223*a*, and second earth connection portion 224*a* to cut off the power supply applied to the microwave oven via the electric cord 100 plugged into an outlet (not shown), the worker is prevented from receiving an electrical shock during repair.

Furthermore, when the push means 210 is moved during removal of the outer panel 50, the cover member 233 of the switch cover means 230 is correspondingly moved along the first and second guide rails 231 and 232 by a elastic force of the first and second springs 234 and 235, thereby covering the switch means 220.

Since the cover member 233 has been made of an insulating material, the first negative pole 222, first positive pole 223 and first earth connection portion 224 remain electrically disconnected from the second negative pole 222*a*, second positive pole 223*a* and second earth connection portion 224*a* to thereby prevent the worker from receiving an electrical shock even if the worker lays his fingers on the cover member 233.

Accordingly, the power supply cut-off apparatus according to the present invention prevents an electric shock possibly caused in the course of a repair work of the microwave oven while an electric cord is still plugged in an outlet, thereby increasing its safety.

As is apparent from the foregoing, there results an advantage from the power supply cut-off apparatus in that an electric connection of a switch is automatically turned off when the outer panel is dismounted while an electric cord is still plugged into an outlet, to thereby cut off a main power supply applied to the microwave oven and prevent an electric shock possibly caused in the course of a repair work of the microwave oven.

What is claimed is:

1. A microwave oven comprising:

a main body forming a cooking chamber;

a microwave generator component disposed in the main body for supplying microwaves to the cooking chamber;

an electric cord for supplying electricity;

an outer panel removably mounted on the main body;

a switch mounted on the main body and including terminals electrically connected to respective electrical components of the microwave oven including the microwave generator component;

a switch cover mounted on the main body for movement between first and second positions in which the electrical cord is electrically connected to and disconnected from, respectively, the terminals; and a pusher mounted on the removable outer panel for pushing the switch cover out of the second position and into the first position in response to the outer panel being attached to the main body.

2. The microwave oven according to claim 1 wherein the switch includes first and second sets of terminals, the first set of terminals connected to respective wires of the electrical cord, and the second set of terminals connected to the electrical components, the pusher carrying conductors for interconnecting respective terminals of the first and second sets when the outer panel is connected to the main body.

3. The microwave oven according to claim 2 further including a spring for biasing the cover to the second position, the spring being yieldable to permit the cover to be moved to the first position by the pusher when the outer panel is mounted to the main body.

4. The microwave oven according to claim 1 further including guide rails mounted to the main body, the switch cover slidably mounted on the guide rails, and a spring biasing the switch cover to the second position thereof.

5. The microwave oven according to claim 4 wherein the switch cover is formed of an electrically insulative material.

* * * * *